US006154608A

United States Patent [19]

Rochelle

[11] Patent Number: 6,154,608

[45] Date of Patent: Nov. 28, 2000

[54] DRY ELEMENT WATER HEATER

[75] Inventor: Gary P. Rochelle, Marina del Rey, Calif.

[73] Assignee: Alpha-Western Corporation, Gardena, Calif.

[21] Appl. No.: 09/210,141

[22] Filed: Dec. 11, 1998

[51] Int. Cl.[7] ..... F24H 1/10; H05B 3/78

[52] U.S. Cl. ..... 392/487; 392/489; 392/501

[58] Field of Search ..... 392/465, 478, 392/485, 487, 488, 489, 500, 449, 451, 453, 455, 457

[56] References Cited

U.S. PATENT DOCUMENTS

| | | | |
|---|---|---|---|
| 798,747 | 9/1905 | O'Hanlon et al. . | |
| 2,589,566 | 3/1952 | Neth et al. | 392/479 |
| 2,799,767 | 7/1957 | Bremer . | |
| 2,866,884 | 12/1958 | Minier . | |
| 3,525,849 | 8/1970 | Bleckmann . | |
| 3,673,385 | 6/1972 | Drugmand et al. . | |
| 3,772,498 | 11/1973 | Temple | 392/501 |
| 4,035,609 | 7/1977 | Vogel . | |
| 4,185,187 | 1/1980 | Rogers . | |
| 4,253,009 | 2/1981 | Jordan . | |
| 4,423,311 | 12/1983 | Varney, Sr. . | |
| 4,461,347 | 7/1984 | Layton et al. | 165/133 |
| 4,848,616 | 7/1989 | Nozaki . | |
| 4,924,069 | 5/1990 | Giordani . | |
| 5,191,634 | 3/1993 | Couch . | |
| 5,775,743 | 7/1998 | Rochelle . | |

OTHER PUBLICATIONS

*Conductive Thermoplastics*, RTP Co., undated, 18 pgs.

*A Handy–Dandy Guide to Heaters with Information on the Causes and Corrections of the Bad Things That Can Happen*, Aquatemp Products Corporation, 1996, 16 pgs.

*Primary Examiner*—Teresa Walberg
*Assistant Examiner*—Thor Campbell
*Attorney, Agent, or Firm*—Christensen O'Conner Johnson Kindness PLLC

[57] ABSTRACT

A water heater assembly (20) is disclosed. The water heater assembly includes a tubular housing (22) having an inlet, an outlet, and a channel extending between the inlet and outlet for passing water through the water heater assembly. A plurality of heating element conduits (102*a*–102*e*) extend between the inlet and outlet. The water heater assembly also includes a plurality of heating elements (100*a*–100*d*) removably disposed within the conduits and extending between the inlet and outlet. The heating element housings surrounding the heating element for sealing the heating element from direct contact with the water and permitting heat transfer between the heating elements and the water passing adjacent the heating element housing. The water heater assembly also includes cylindrical first and second end caps (62 and 62*b*). One end cap being releasably fastened to one of either the inlet or outlet of the housing. Each end cap has a sealed end and a hole (76) extending through and off the center of the sealed end. The hole is sized to receive inlet and outlet tubes (42*a* and 42*b*) therethrough for providing flowthrough passages into and out of the housing.

19 Claims, 6 Drawing Sheets

DRY ELEMENT WATER HEATER

FIELD OF THE INVENTION

The present invention relates generally to electric water heaters and, more particularly, to a dry element flowthrough water heater.

BACKGROUND OF THE INVENTION

Flowthrough water heaters are used to heat water in a wide variety of applications, such as spas, hot tubs and pools. A typical water heater includes an electric heating element contained within a fabricated stainless steel heater housing. A section of the housing may be flattened to define a mounting surface through which the heating element is installed and electrically connected. At least one aperture extends through the mounting surface, and is sized to receive the terminal ends of the heating element therethrough. The heating element is constructed from a heating coil that has two terminal ends, each connected to a cold pin. The heating coil and the cold pins are coaxially housed within a tubular outer sheath of stainless steel and the sheath is filled with a dielectric material. An annular metal bulkhead flange is typically braised or welded about the outer sheath, adjacent each end of the element.

Mounting of the heating element is typically completed by placing a gasket on the bulkhead and then securing a nut to the exterior of the terminal ends to compress the gasket. As mounted to the housing, the heating element is submerged directly into the water. As water passes through the housing, heat is transferred to the water from the heating elements. thereby causing the water to increase in temperature. Although submerging heating elements within water is an effective method of heating water, it is not without its problems.

First, because the heating elements are submerged within the water, they are subject to failure due to corrosion. Additionally, because such water heaters are used in an environment where the water is chemically treated, corrosion mechanisms include galvanic corrosion, chemical pitting and electrochemical corrosion. Further, because the welded or brazed joint between the bulkhead flange and outer sheath of the heating element is typically submerged in water, it too is subject to failure due to corrosion. When the element or a weld fails, the entire heater assembly typically must be replaced. Finally, as a result of holes being drilled through the housing for attachment of the heating elements, such water heaters are also expensive to manufacture. Any changes in the number or size of the heating elements in a conventional water heater, or the flow capacity of the heater housing, requires a specially sized and/or drilled housing.

Thus, there exists a need for a water heater that not only has a high degree of corrosion resistance, but is also economical to manufacture and maintain.

SUMMARY OF THE INVENTION

A water heater assembly constructed in accordance with the present invention includes a housing having an inlet, an outlet and a channel extending between the inlet and outlet for passing water through the water heater assembly. The water heater assembly also includes at least a first heating element conduit extending between the inlet and outlet. A first heating element is disposed within the conduit and extends between the inlet and outlet of the housing. The heating element conduit surrounds the heating element, sealing the heating element from direct contact with water while permitting heat transfer from the heating elements through the conduit and to the water flowing past the heating element conduit.

In accordance with other aspects of this invention, the water heater assembly further includes cylindrical first and second end caps. The inlet and outlet of the housing each have one of the end caps releasably sealed thereto. Each end cap has a sealed end face, and defines a hole extending through and off-center of the sealed end face. The hole is sized to receive and seal about an inlet or outlet tube for providing flow passages into and out of the housing. The end caps also each define another hole sized to receive and seal about a corresponding end of the heater element conduit.

In accordance with yet other aspects of this invention, the water heater assembly includes a bypass tube and first and second bypass tube holders. A tube holder is coaxially received within an end of each respective inlet and outlet tube located adjacent the housing. Opposite ends of the bypass tube are slidably received within the two tube holders to provide a sealed passage between the inlet and outlet of the housing, wherein a portion of the water flowing through the heater housing is diverted through the bypass tube without contacting the heating element conduit.

In accordance with further aspects of this invention, the water heater assembly further includes a plurality of tubular heating element conduits extending between the inlet and outlet, each carrying a corresponding heater element or a return electrical lead. Each heating element conduit is received within and sealed to corresponding holes in the first and second end caps.

In accordance with other aspects of this invention, the water heater assembly further includes an electrically conductive bridgework spanning between one set of ends of the conduit sheathing the heating elements for providing a ground path between each heating element conduit. On the electrical terminals of the heating elements, a set of bridges connects the heating elements in parallel for power supply.

A water heater assembly formed in accordance with the present invention has several advantages over currently available water heaters. First, because the heating elements are shielded from direct contact with the water flowing through the assembly by the heating element housings, the elements are not subject to corrosion. As a result, such a water heater assembly has a longer useful life when compared to those having the heating element submerged directly into contact with the water. Second, because such a water heater has multiple heating elements, it remains operable should one or more of the heating elements fail. Further, in the event of one or more of the heating elements failing, they may be easily replaced. As a result, such a water heater is cheaper to maintain. Thus, a water heater assembly formed in accordance with the present invention is corrosion resistant, is rapidly and inexpensively assembled, has a longer useful life and is easier to maintain.

The water heater assembly of the present invention is also highly adaptable for different configurations. Thus a longer heater housing and elements, or more or fewer heater elements, etc., may be utilized with common end caps to change the heater capacity and ratings while avoiding the need for custom parts. Differing material components can be selected and incorporated into the assembly for different use environments. Preferred embodiments use split ring and nut assemblies for mounting hardware within the housing, thereby providing for rapid changeout of components as may be desired.

Additional advantages provided for by preferred embodiments of the invention include the enablement of the most efficient heat transfer from the heater elements through use of a bypass tube. The inlet and outlet tubes provide for ready purging of air from the heater housing, while the heater element conduits can be disposed radially offset from the inlet and outlet tubes and can be positioned lower than the inlet/outlet tubes to reduce dry fire possibilities. However, the heater assembly can be disposed in any orientation, as desired. The straight through arrangement of multiple heater element conduits in preferred embodiments of the invention allows the accommodation of 1 or 3 phase electrical power, accommodates all power wiring at one end of the assembly, facilitates the selection of different voltage combinations from multiple elements, and enables the selective stepping of starting load or the varying of applied heater element load by independent controls. In summary, heater assemblies constructed in accordance with the present invention are versatile for varied usage conditions and performance requirements.

BRIEF DESCRIPTION OF THE DRAWINGS

The foregoing aspects and many of the attendant advantages of this invention will become better understood by reference to the following detailed description, when taken in conjunction with the accompanying drawings, wherein.

DETAILED DESCRIPTION OF THE PREFERRED EMBODIMENT

Figure 1:
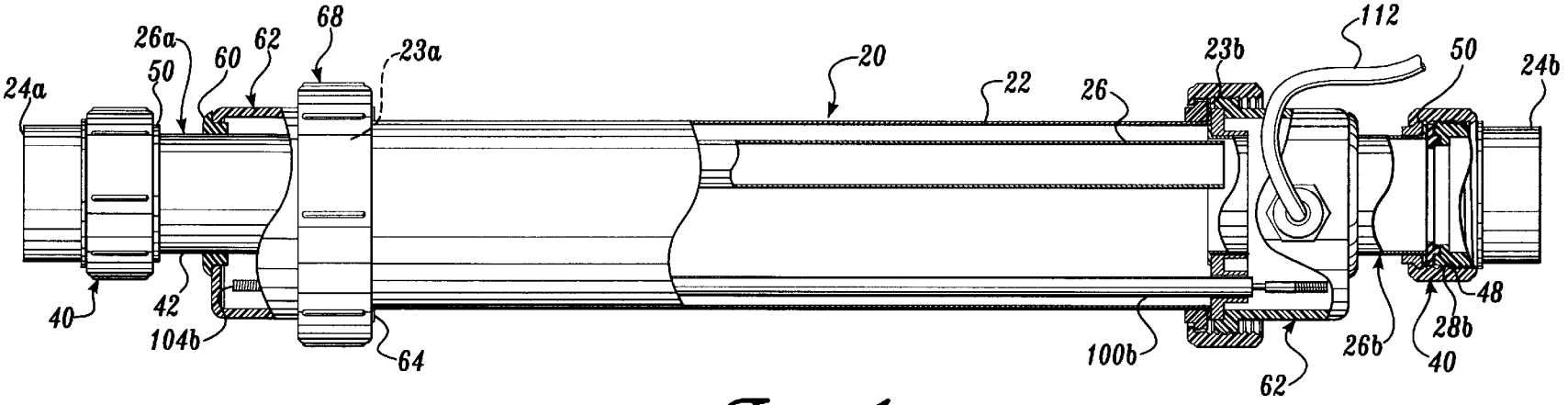
FIG. 1 is a side elevation, partial cross-sectional view of a flowthrough water heater formed in accordance with the present invention.

FIG. 1 illustrates a preferred embodiment of a flowthrough water heater 20 constructed in accordance with the present invention. In a preferred embodiment, the water heater 20 includes a heater housing 22 connected to a piping system (not shown) to heat a fluid, such as spa water. Although the water heater 20 of the present invention is described as heating spa water, it will be appreciated that such a water heater 20 is not intended to be so limited. Thus, a water heater formed in accordance with the present invention is suitably used in any number of applications, such as a bath, a pool, a hot tub or a water heating tank for commercial or residential buildings or any other application where a corrosion resistant water heater is required.

The heater housing 22 is an elongate, hollow cylinder made of corrosion resistant metal, such as stainless steel. Each end of the heater housing 22 includes an annular flange 23*a* and 23*b* extending radially outwards from the outside diameter of the heater housing 22, and is coupled to first and second pipes 24*a* and 24*b* of the piping system. Each pipe 24*a* and 24*b* is suitably manufactured from polyvinylchloride (PVC) and includes externally threaded ends 28*a* and 28*b*. The ends of the heater housing 22 are releasably coupled to the pipes 24*a* and 24*b* by identically configured first and second attachment assemblies 26*a* and 26*b*.

Figure 2:
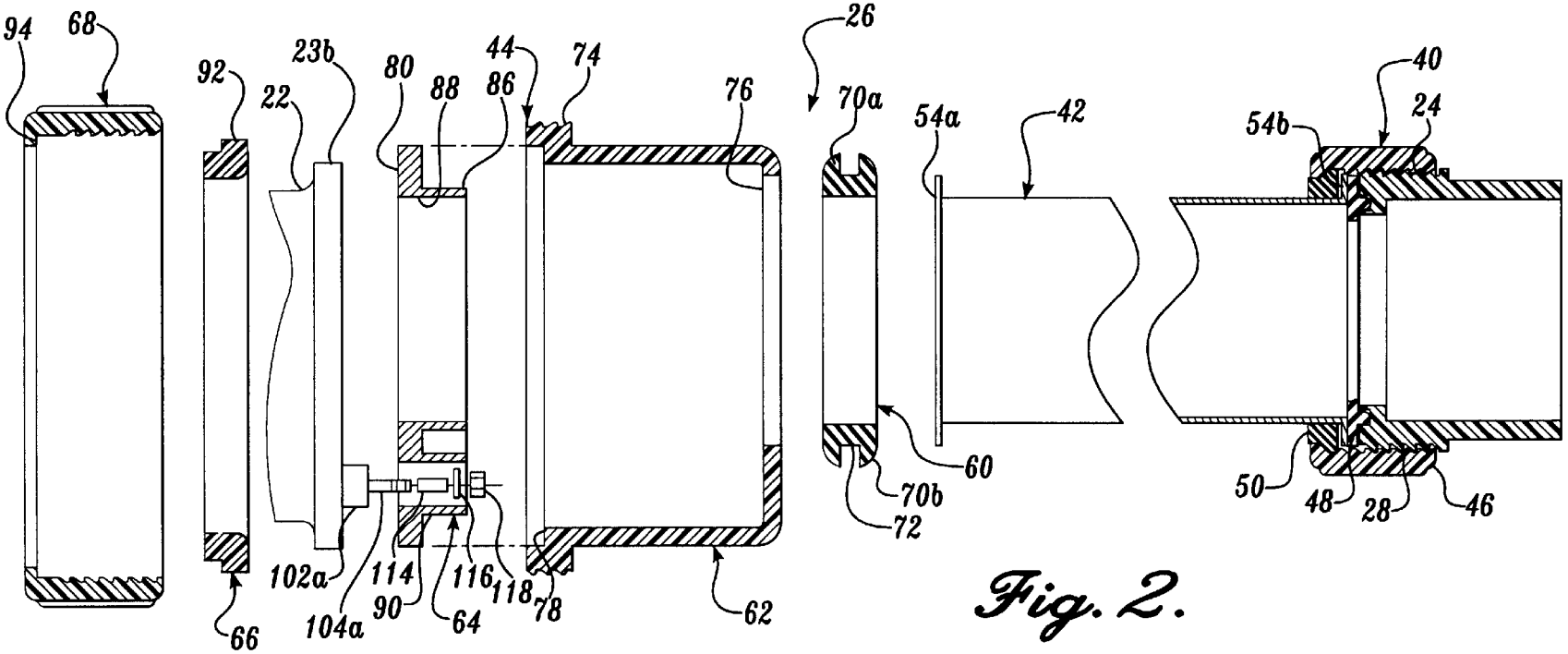
FIG. 2 is an exploded side elevation, partial cross-sectional view of an attachment assembly for a flowthrough water heater formed in accordance with the present invention.

The attachment assemblies 26*a* and 26*b* may be best understood by referring to FIG. 2. Because each attachment assembly 26*a* and 26*b* is identically configured, only one attachment assembly will be described in detail. However, it is to be noted that the description of one attachment assembly is applicable to the other.

The attachment assembly 26 includes a nut and split ring assembly 40, a connector pipe 42 and a pipe to heater attachment assembly 44. A suitable nut and split ring assembly 40 is set forth in U.S. Pat. No. 5,775,743, issued to Rochelle, the disclosure of which is hereby incorporated by reference. Such a nut and split ring assembly 40 includes an annular nut 46, an annular gasket 48 and an annular split insert 50. The nut 46 is internally threaded and is sized to threadably engage the externally threaded end 28 of the pipe 24, such that the opposite end of the nut 46 sealingly engages the split insert 50 to sealingly fasten one end of the connector pipe 42 against the gasket 48.

The connector pipe 42 is an elongate, hollow cylinder made of a corrosion resistant metal, such as stainless steel. The connector pipe 42 includes first and second annular flanges 54*a* and 54*b* extending radially outward from opposite ends of the connector pipe 42. As described above, one end of the connector pipe 42 is sized to be sealingly received within the nut and split ring assembly 40. The other end is sized to be sealingly fastened within the pipe to heater attachment assembly 44. The connector pipe 42 of each attachment assembly 26*a*, 26*b* serves as an inlet or outlet for the heater assembly.

The pipe to heater attachment assembly 44 includes a grommet 60, an end cap 62, an annular end plate 64, an annular split insert 66 and an annular nut 68. The annular grommet 60 is suitably manufactured from a flexible and durable material, such as rubber, and includes an annular notch 72 extending around the outside perimeter of the grommet 60. The notch 72 is centrally located between the annular ends of the grommet 60. The grommet 60 also includes first and second annular flanges 70*a* and 70*b* extending radially outward from opposite ends of the grommet 60 and a centrally located aperture (not shown) extending through the thickness thereof. The aperture of the grommet 60 is sized to be slidably received on the outside diameter of the connector pipe 42, such that a seal is defined between the aperture of the grommet 60 and the connector pipe 42. Alternately, in place of the grommet 60, an interlocking two-piece end cap may be utilized.

The end cap 62 is a hollow cylinder and is suitably injection molded from a structural thermoplastic or thermosetting material, or a metal. A first end 74 of the end cap 62 is open to the interior and is externally threaded. The first end 74 also includes an annular shoulder 78 extending radially inwards toward the center of the end cap 62. The shoulder 78 is sized to receive the end plate 64 therein, as is described in greater detail below. The other end of the end cap 62 is sealed and includes a hole 76 extending therethrough. The hole 76 is positioned off the center of the sealed end, such that it is located towards one perimeter edge of the end cap 62. The diameter of the hole 76 is sized to be received within the notch 72 of the grommet 60, such that the notch 72 and the flanges 70*a* and 70*b* define a seal around the perimeter of the hole 76.

Still referring to FIG. 2, the end plate 64 will now be described in greater detail. The annular end plate 64 is suitably manufactured from a pliable and flexible material, such as rubber, and includes a first end 80 and a second end 82. The end plate 64 also includes an annular first collar 86 integrally formed with and extending outwardly from the second end 82. Extending through the end plate 64 and centrally through the first collar 86 is a circular passage 88. The passage 88 has a diameter equal to the outside diameter of the inlet or outlet connector pipe 42, such that a seal is defined therebetween when the connector pipe 42 is slidably received within the end plate 64, as is described in greater detail below. A NYLON® polyamide tie-wrap fastener or other type of annular clamp is then tightened about the first collar 86 and connector pipe 42 to create a pressure-tight seal.

Figure 3:
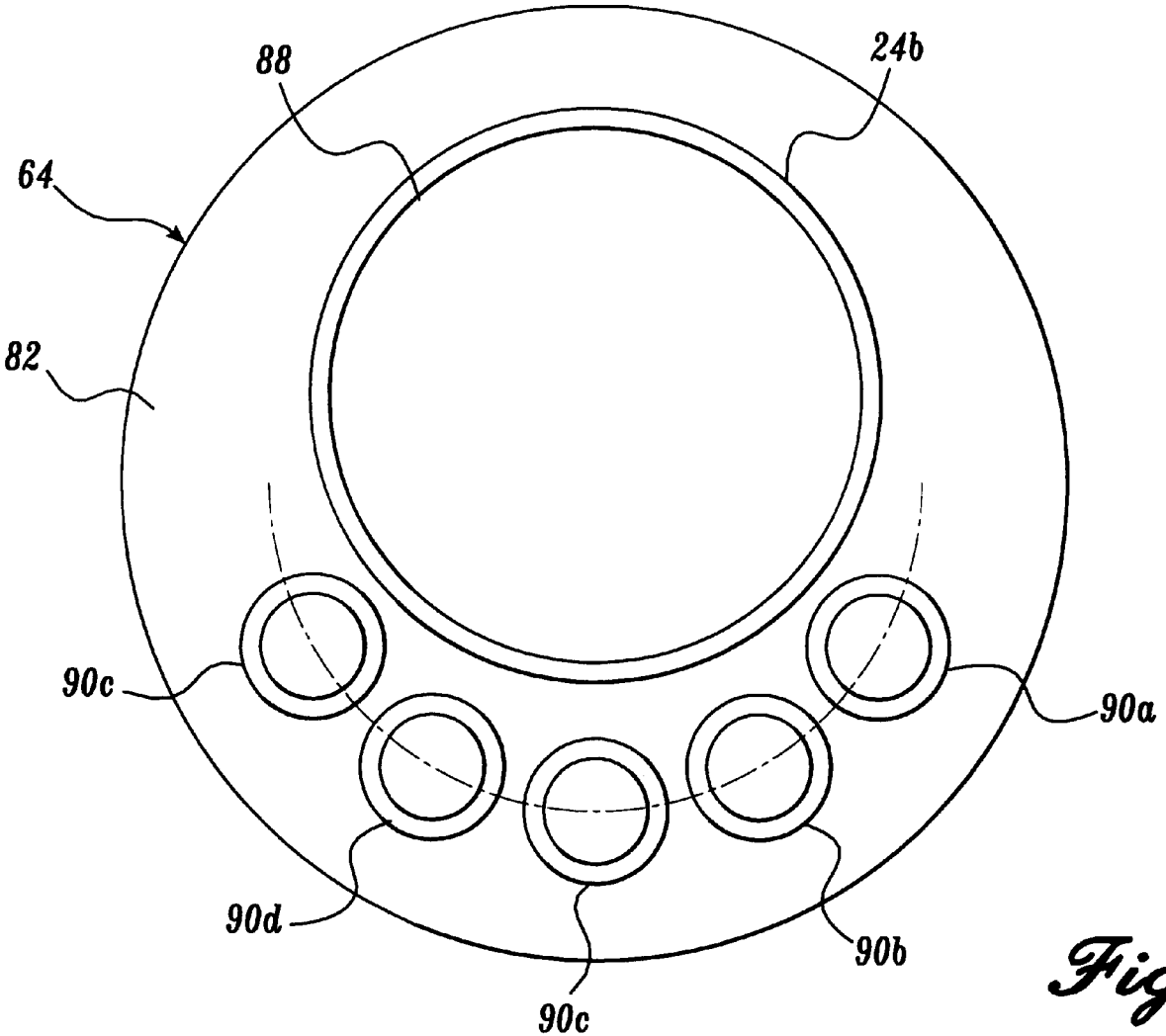
FIG. 3 is an end planar view of an end plate for a flowthrough water heater formed in accordance with the present invention.
Figure 4:
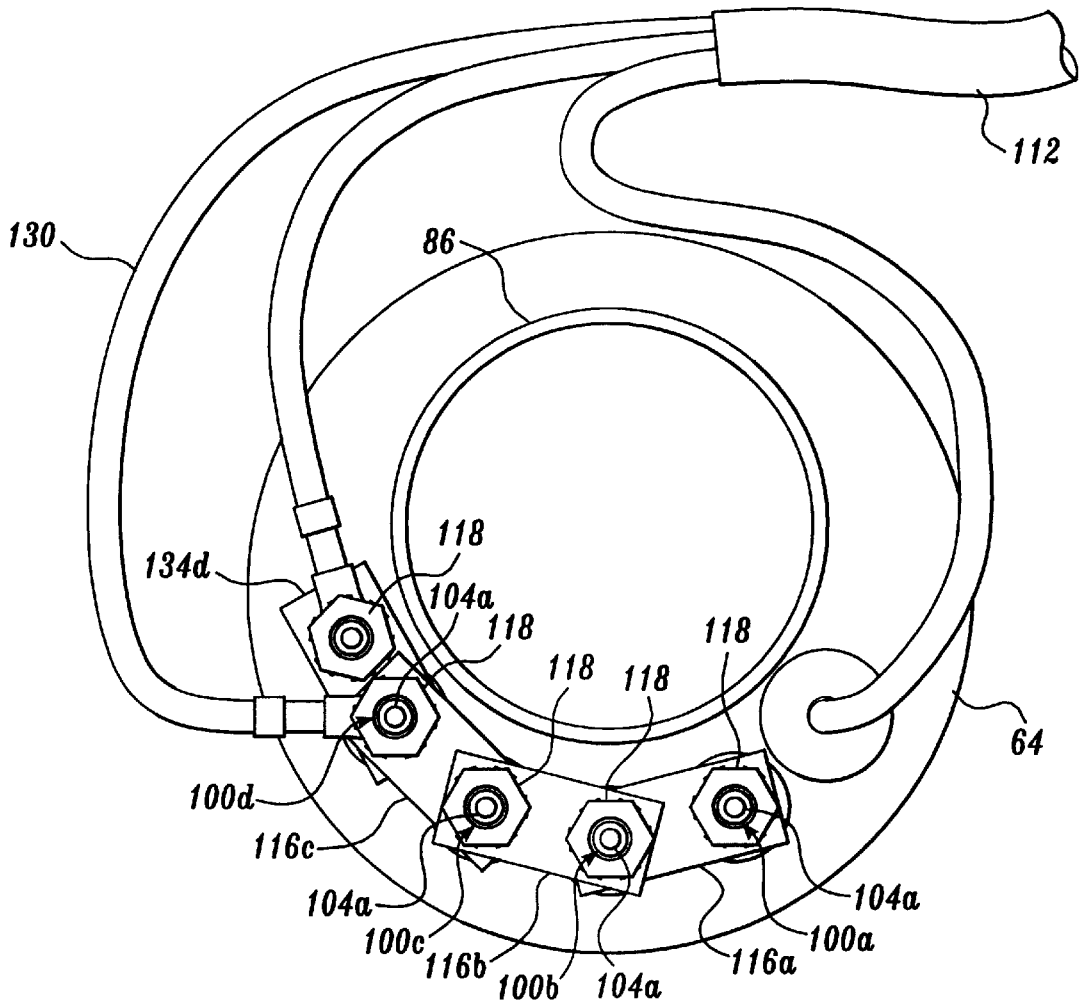
FIG. 4 is an end planar view of a flowthrough water heater formed in accordance with the present invention, showing the attachment of the heating elements to a first end of the water heater.

As may be seen best by referring to FIGS. 2 and 3, the end plate 64 also includes a plurality of annular collar fittings 90*a*–90*e*. Each collar fitting 90*a*–90*e* is integrally formed with the end plate 64 and extends radially outward from the second end 82 of the end plate 64. The collar fittings 90*a*–90*e* are preferably located below the first collar 86. Thus the first collar 86 is offset radially from the center of the end plate 64 in a first direction while the collar fittings 90*a*–90*e* are offset in the opposite direction.

The end plate 64 is sized to be received within the first end 74 of the end cap 62, such that the first collar 86 and the collar fittings 90*a*–90*e* are received within and project into the end cap 62 and the end plate 64 is seated against the shoulder 78. As received within the end cap 62, the second end 84 of the end plate 64 defines a seal with the shoulder 78. Further, the inlet or outlet connector pipe 42 is slidably received through the passage 88 of the end plate 64, such that the inwardly facing side of the flange 54*a* is seated against the first end 80 of the end plate 64 to define a seal therebetween.

As assembled, the end cap 62 is then fastened to the heater housing 22 by the insert 66 and the internally threaded nut 68. Both the insert 66 and nut 68 are suitably made of a polyvinylchloride or other thermoplastic, such as NYLON® polyamide or acrylonitrile-butadien-styrone (ABS) polymers. The annular insert 66 includes an annular extension portion 92 facing the flange 23 of the heater housing 22, such that the extension portion 92 is retained against the flange 23 when assembled. The insert 66 includes a radially oriented split 93 that allows the annular insert 66 to temporarily expand to slip over the flange 23 of the heater housing 22 during assembly. The other end of the insert 66 is seated against an annular retaining section integrally formed within the nut 68. The retaining section extends radially inward from the inside diameter of the nut 68 to define an annular shoulder 94. The shoulder 94 is sized to engage the extension portion 92 of the insert 66, as is described in greater detail below. The annular insert 66 and nut 68 are also suitably constructed in accordance with U.S. Pat. No. 5,775,743.

In practice, the nut 68 is slid over the annular flange 23 of the heater housing 22 onto the main body portion of the heater housing 22, such that the shoulder 94 of the nut 68 faces the flange 23 of the heater housing 22. Thereafter, the insert 66 is slid over the flange 23 by resiliently deforming the insert 66 to form a gap at the split 93, such that the extension portion 92 is seated against the shoulder 94 of the nut 68. The nut 68 is then threadably secured to the externally threaded end 74 of the end cap 62, with the insert 66 seated between the shoulder 94 of the nut 68 and the flange 23 of the heater housing 22, thereby coupling the attachment assembly 26 to the heater housing 22.

As may be best seen by referring to FIGS. 1–5, the water heater 20 includes a plurality of straight heating elements 100*a*–100*d* and tubular heater conduits 102*a*–102*e*. Each heating element 100*a*–100*d* includes externally threaded electrical terminals 104*a* and 104*b*, a pair of cold pins 106*a* and 106*b* and a heating coil 108 coaxially received within an outer sheath 110. Each end of the heating coil 108 is connected (not shown) in a well known manner, such as a contact joint, to one end of the cold pins 106*a*–106*b*. Welded in a conventional manner to the other end of the cold pins 106*a*–106*b* is one of the electrical terminals 104*a* and 104*b*. The heating coil 108 and the lower portion of the cold pin 106 are surrounded by a dielectric material (not shown), such as magnesium oxide, within the outer sheath 110. As assembled, each one of the heating elements 100*a*–100*d* is then coaxially and slidably received within one of the tubular housings 102*a*–102*d*.

Each tubular conduit 102*a*–102*e* is an elongate, hollow cylinder suitably made of a corrosion-resistant metal, such as stainless steel. The housings 102*a*–102*d*, including a corresponding heating element 100*a*–100*d*, are longitudinally disposed within the heater housing 22, such that they extend between the end plates 64 of each attachment assembly 26*a* and 26*b*. As may be best seen by referring to FIGS. 2 and 3, each end of each conduit 102*a*–102*d* is slidably received within one of the annular collar fittings 90*a*–90*d* of the end plates 64. The inside diameter of each of the collar fittings 90*a*–90*d* is slightly smaller than the outside diameter of the conduits 102*a*–102*d*, such that it fits tightly around the outside diameter of each conduit 102*a*–102*d* when the conduits 102*a*–102*d* are received therein. Thus, as received within the collar fittings 90*a*–90*d*, opposing ends of the conduits 102*a*–102*d* sealingly engage opposing end plates 64. To ensure a tighter seal around each of the conduits 102*a*–102*d*, a well-known fastener (not shown), such as a plastic tie fastener (i.e., a "tie wrap"), may be securely fastened around the outside perimeter of each collar fitting 90*a*–90*d*.

While the end plates 64 have been described as made of an elastomer that provides an integral bulkhead and seal, other constructions are also within the scope of the present invention. Thus a metal bulkhead with sealing collars that receive O-ring type elastomeric seals could alternately be used, although this would raise the manufacturing cost and thus is not preferred.

Preferably, the conduits 102*a*–102*d* are located radially offset from the passage 88 extending through the end plate 64, such that the conduits 102*a*–102*d* containing the heating elements 100*a*–100*d* may be positioned in the lower portion of the heater housing 22 for horizontal installations. As a result, the heating elements 100*a*–100*d* remain below the water line to reduce the possibility of dry fire. The heater assembly of the present invention may also be disposed vertically or at other angled orientations as well as horizontal. Further, as housed within the tubular conduits 102*a*–102*d* and sealed between the end plates 64, each heating element 100*a*–100*d* is sealed from direct contact with water flowing through the water heater 20. Although the heating elements 100*a*–100*d* are isolated by the conduits 102*a*–102*d* from direct contact with water passing through the water heater 20, heat transfer between the heating elements 100*a*–100*d* and the water remains uninterrupted by the thermally conductive conduits 102*a*–102*d*.

Figure 5:
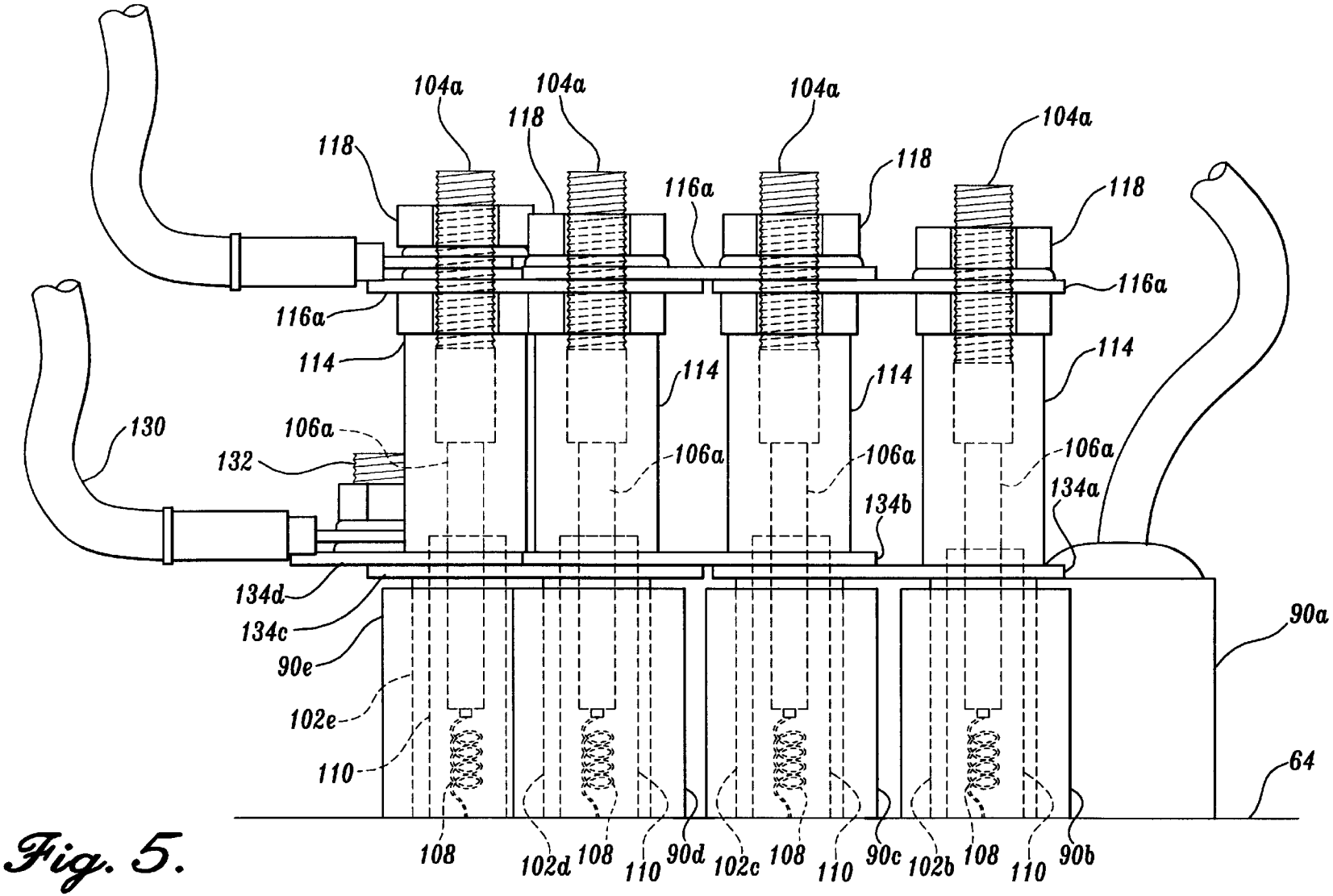
FIG. 5 is a side view of a flowthrough water heater formed in accordance with the present invention showing the attachment of the heating elements to a first end of the water heater.

Mounting of the heating elements 100*a*–100*d* to each end plate 64 may be best understood by referring back to FIGS. 2, 4 and 5. After the heating element is slid into an installed conduit, a grounding bridgework is installed. As seen in FIG. 5, a ground cable 130 extends from the electrical cabling 112 and is threadably fastened to the grounding bridgework, as described below. The grounding bridgework includes a plurality of rectangularly shaped and electrically conductive grounding plates 134*a*–134*d*. Grounding plates 134*a*–134*c* include a pair of bores (not shown) extending through opposite ends of each plate. The fourth grounding plate 134*d* includes a threaded post 132 extending from one end. The first plate 134*a* is slidably received on two adjacent heating elements, such that the heating elements extend through the bores. The lower surface of the plate 134*a* is seated against an end of the conduit 102*a* and 102*b* housing a heating element. The remaining grounding plates 134*b*–134*d* are then similarly received on the remaining adjacent heating elements such that the second plate 134*b* overlaps one end of the first and third plates 134*a* and 134*c*. The fourth grounding plate 134*d* is similarly received on the first post 132 and the fourth heating element 100*d* to provide a ground path between each heating element conduit. The fourth grounding plate 134*d* includes a threaded post 132 extending from one end. The post 132 is threadably fastened to the ground cable 130 by a nut. As a result, the grounding plates 134*a*–134*d* are placed into contact with each other and are seated against the conduits 102*a*–102*d*.

After the grounding bridgework is installed, a tubular spacer 114, suitably formed from a thermoplastic or other dielectric material, is slidably received on a portion of the electrical terminal 104 extending out from the collar fitting 90*a*–90*d*. A rectangularly shaped and electrically conductive connection bracket 116 (i.e., a bridge) is then received on the upper ends; of adjacent heating elements to electrically connect adjacent heating elements. As may be best seen by referring to FIGS. 4 and 5, a total of three connection brackets 116 are used to electrically connect, in parallel, four heating elements 100*a*–100*d*. on one end of the heater assembly. An internally threaded nut 118 is then threadably fastened to the electrical terminal of each heating element 100*a*–100*d*.

Similar dielectric spacers, conductive bridges and fasteners are installed on the opposite end of the heater assembly, thereby connecting the heating elements in parallel. As connected by the connection bracket 116, the connection brackets 116 span between the heating elements 100*a*–100*d* also provide a ground path between each heating element 100*a*–100*d*.

Electrical power is supplied to a first end of each heating element 100*a*–100*d* in a well known manner from an external source (not shown) by electrical cabling 112. A return leg of electrical cabling 112 is attached to the opposite end of each heating element 100*a*–100*d*, and is threaded back to the first end longitudinally within an additional heater conduit 22 mounted within a tubular housing 102*e*. The electrical cabling 112 is also isolated from direct contact with water passing through the water heater 20. Thus, by way of non-limiting example, for a heater assembly utilizing three electric heat elements, four conduits are preferably provided, with the extra being for return cabling. All electrical feed and connections to the power supply source can thus be made at one end of the housing.

In use, water flows into an inlet pipe 42, into the interior of the housing 20, around and past the heated heater conduits 22*a*–22*d*, and out the outlet pipe 42.

Figure 7:
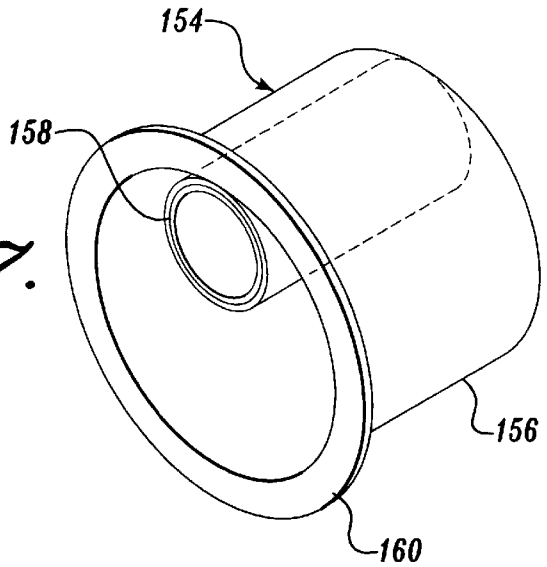
FIG. 7 is a perspective view of a bypass tube holder for a flowthrough water heater formed in accordance with the present invention.
Figure 8:
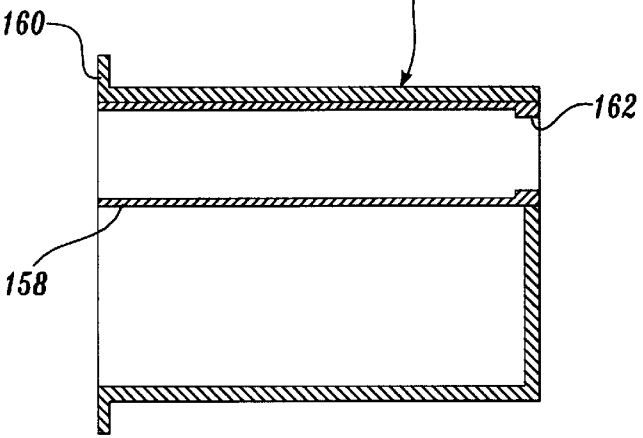
FIG. 8 is a cross-sectional side view of a bypass tube holder for a flowthrough water heater formed in accordance with the present invention.
Figure 6:
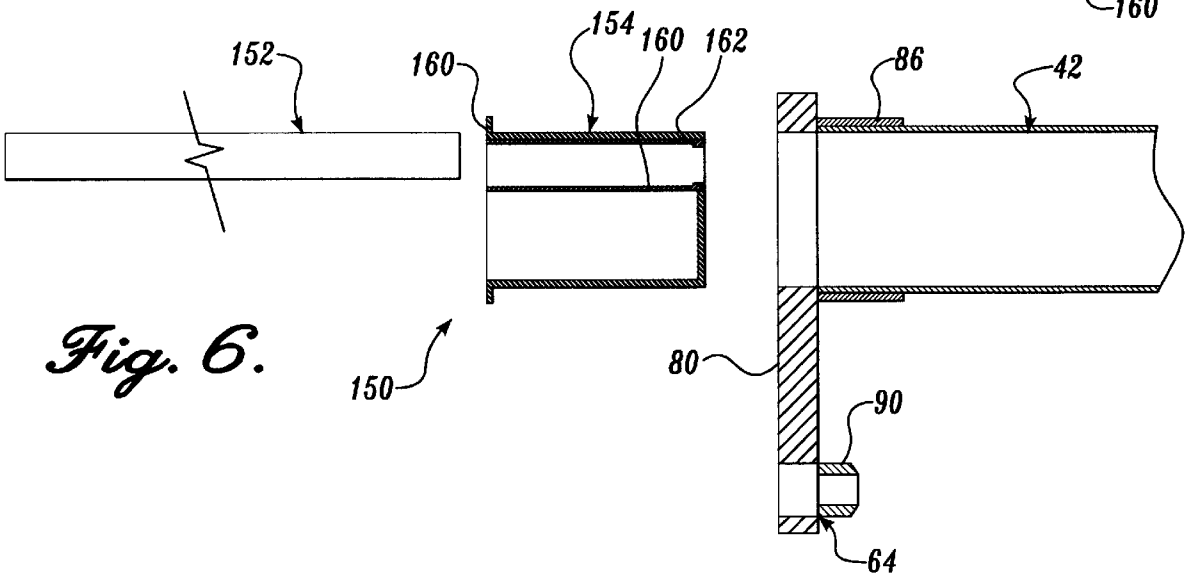
FIG. 6 is an exploded view of a bypass tube assembly for a flowthrough water heater formed in accordance with the present invention.

Referring to FIGS. 6–8, an alternate embodiment of the water heater 20 will now be described. The water heater 20 of the alternate embodiment is identical in construction as that described above for the preferred embodiment with the exception that the alternate embodiment includes a water bypass assembly 150. The water bypass assembly 150 includes a bypass tube 152 and a pair of identically configured bypass tube holders 154. The bypass tube 152 is an elongate, hollow cylinder made of a corrosion-resistant metal, such as stainless steel. The bypass tube 152 is slightly longer in length than the heater housing 22, such that the ends of the bypass tube 152 extend at least partially into the connector pipes 42, as is described in greater detail below.

Each bypass tube holder 154 is suitably injection molded from a thermoplastic and includes a cylindrical body portion 156 and a cylindrical bypass tube receptacle 158. Alternately, the holder 154 may be formed of metal or other materials. The body portion 156 includes an integrally formed annular flange 160 extending radially outward from one end of the body portion 156. The bypass tube receptacle 158 is integrally formed within the cylindrical passage of the body portion 156 of the tube holder 154, such that the tube receptacle 158 is received within the body portion 156. As may be best seen by referring to FIG. 8, the receptacle 158 is substantially located within the upper half of the inside diameter of the body portion 156. Located within the end of the tube receptacle 158 received within the body portion 156 is an annular flange 162. The flange 162 is integrally formed with the inside diameter of the receptacle 158 and extends radially inward towards the center of the receptacle 158. The inside diameter of the tube receptacle 158 is substantially equal to the outside diameter of the bypass tube 152, such that the bypass tube 152 may be slidably received therein.

Assembly of the bypass assembly 150 within the water heater 20 may be best understood by referring back to FIG. 6. Each end of the bypass tube 152 is slidably received within the tube receptacle 158 of one of the tube holders 154 until it is seated against the flange 162. As assembled, the bypass tube 152 is then slidably received within the heater housing 22 and each bypass tube holder 154 extends outwardly from the ends of the heater housing 22. The tube holders 154 are then slidably received within the passage 88 of each end plate 64. The bypass tube holders 154 are slid into the connector pipes 42 until the flange 160 of the tube holder 154 is seated against the first end 80 of the end plate 164. Thus, as assembled to the water heater 20, the bypass tube 152 extends between each end of the heater housing 22 and provides a separate conduit for diverting water passing through the water heater 20. As a result, the bypass tube 152 permits a predetermined amount of water to pass through the water heater 20 without contacting the heating element conduits 102*a*–102*d* of the water heater 20. The bypass tube diameter may be changed for a given flow rate or electrical output such that only a predetermined portion of water flows over the heater conduits 102*a*–102*d* for maximum efficiency.

From the foregoing description it can be seen that a water heater formed in accordance with the present invention incorporates many novel features and offers significant advantages over currently available flowthrough water heaters. It will be apparent to those of ordinary skill that the embodiments of the invention illustrated and described herein are exemplary only and, therefore, changes may be made thereto, while remaining within the scope of the invention. As a non-limiting example, a water heater formed in accordance with the present invention may have more or fewer heating elements, such as five or three heating elements, extending longitudinally within the heater housing. Thus, it may be appreciated that various changes can be made to the embodiments of the invention without departing from the spirit and scope of the invention.

The embodiments of the invention in which an exclusive property or privilege is claimed are defined as follows:

1. A water heater assembly, the water heater assembly comprising:

(a) a housing having an inlet, an outlet and a channel extending between the inlet and outlet for passing water through the channel;

(b) a first electrical heating element conduit disposed within the channel of the housing and extending between the inlet and outlet;

(c) a first heating element removably disposed within the conduit, the heating element conduit surrounding the heating element for sealing the heating element from direct contact with the water while permitting heat transfer between the heating element and water flowing about the heating element conduit; and (d) at least a first elastomeric end plate mounted to the housing and seated over one of the inlet or outlet, the first elastomeric end plate defining at least a first aperture that receives and is pliably sealed to the first electrical heating element conduit.

2. The water heater assembly of claim 1, further comprising a support member fastened to the other of the inlet and outlet of the housing for releasably supporting a corresponding inlet or outlet pipe within the housing.

3. The water heater assembly of claim 2, wherein the support member comprises a second end plate releasably fastened to the other of the inlet and outlet of the housing, each of the first and second end plates having an annular first collar sized to receive one of an inlet or outlet tube extending therethrough, the first collar extending radially outwards from the end plate.

4. The water heater assembly of claim 3, wherein each of the first and second end plates is formed from an elastomeric material and includes a plurality of annular sealing collars integrally formed with one side of the end plate, each sealing collar extending radially outwards from the end plate.

5. The water heater assembly of claim 4, wherein the sealing collars are located below the first collar, such that the first collar is offset radially from the center of the end plate in a first direction while the sealing collars are offset in a direction opposite from the first collar.

6. The water heater assembly of claim 5, wherein the support members further comprising cylindrical first and second end caps releasably fastened to the inlet and outlet, respectively, each end cap having a sealed end and a hole extending through and off the center of the sealed end, the hole being sized to receive the end plates and inlet and outlet tubes therethrough for providing flow passages into and out of the housing.

7. The water heater assembly of claim 3, further comprising a plurality of tubular heating element conduits extending between the inlet and outlet, the heating element conduits arranged radially around each end plate and below the first collar formed in each end plate, each heating element conduit having a heating element removably disposed therein for removing the heating elements from direct contact with the water.

8. The water heater assembly of claim 7, further comprising an electrically conductive bridgework spanning between the ends of the heating element conduits for providing a ground path between each heating element conduit.

9. The water heater assembly of claim 8, wherein each end plate further comprising an annular electrical cable collar fitting integrally formed with the first side of the end plate, the electrical cable collar fitting extending radially outwards from the first side of the end plate and offset radially from the collar fitting.

10. The water heater assembly of claim 9, wherein the plurality of heating elements are disposed within the housing and longitudinally extend between the end plates along a substantially straight path therebetween.

11. A water heater assembly, the water heater assembly comprising:

(a) a housing having an inlet, an outlet and a channel extending between the inlet and outlet for passing water through the channel;

(b) a first electrical heating element conduit disposed within the channel of the housing and extending between the inlet and outlet; and (c) a first heating element removably disposed within the conduit, the heating element conduit surrounding the heating element for sealing the heating element from direct contact with the water while permitting heat transfer between the heating element and water flowing about the heating element conduit, further comprising a bypass conduit extending between the inlet and outlet of the housing to divert a predetermined amount of water entering the inlet to pass through the water heater assembly without contacting the heating element conduit.

12. The water heater assembly of claim 11, wherein the bypass conduit comprises a bypass tube and first and second bypass tube holders, the tube holders being coaxially received within the inlet and outlet tubes, opposite ends of the bypass tube being slidably received within the tube holders for providing a sealed passage between the inlet and outlet of the housing.

13. A water heater assembly comprising:

(a) a tubular housing having an inlet, an outlet and a channel extending between the inlet and outlet for passing water through the water heater assembly;

(b) a plurality of electrical heating elements disposed within the channel and extending between the inlet and outlet of the housing, each heating element being coaxially received within a tubular element conduit for sealing the heating element from direct contact with the water while permitting heat transfer between the heating elements and the water flow about the element conduits; and (c) a water bypass assembly disposed within the channel and extending between the inlet and outlet of the housing, the bypass assembly providing a sealed passage between the inlet and outlet of the housing to divert a predetermined amount of water entering the inlet to pass through the housing without contacting the heating element housing.

14. The water heater assembly of claim 13, further comprising support members fastened to the inlet and outlet of the housing for releasably supporting inlet and outlet tubes within the housing.

15. The water heater assembly of claim 14, wherein each support member further comprising an end plate releasably fastened to each of the inlet and outlet of the housing, each end plate having an annular first collar sized to receive one of the inlet or outlet tubes therethrough, the first collar extending radially outwards from the end plate.

16. The water heater assembly of claim 15, wherein the support members further comprising cylindrical first and second end caps threadably fastened to the inlet and outlet, respectively, each end cap having a sealed end and a hole extending through and off the center of the sealed end, the hole being sized to receive the end plates and inlet and outlet tubes therethrough for providing flow passages into and out of the housing.

17. The water heater assembly of claim 16, further comprising an electrically conductive bridgework spanning between the ends of the element conduits for providing a ground path between each heating element conduit.

18. A water heater assembly, comprising:

(a) a tubular housing having an inlet, an outlet and a channel extending between the inlet and outlet;

(b) first and second end caps releasably fastened to the inlet and outlet respectively each end cap having a sealed end and a hole extending through and off the center of the sealed end;

(c) a plurality of heating element conduits extending between the inlet and outlet, each heating element conduit being positioned below each hole of the end caps;

(d) a plurality of electrical heating elements removably disposed within the conduits; and (e) at least one seal mounted on the heating element conduits to seal the heating element from direct contact with the water while permitting heat transfer between the enclosed heating element and water flowing about adjacent the heating element conduit, further comprising a water bypass assembly extending between the inlet and outlet of the housing to divert a predetermined amount of water entering the inlet to pass through the water heater assembly without contacting the heating element conduit.

19. A water heater assembly, the water heater assembly comprising:

(a) a housing having an inlet, an outlet and a channel extending between the inlet and outlet for passing water through the channel;

(b) a first electrical heating element conduit disposed within the channel of the housing and extending between the inlet and outlet;

(c) a first heating element removably disposed within the conduit; and (d) at least one elastomeric seal mounted on and sealed to the heating element conduit to seal the heating element from direct contact with the water while permitting heat transfer between the heating element and water flowing about the heating element conduit.

* * * * *